US005361961A

United States Patent [19]

Kobayashi et al.

[11] Patent Number: 5,361,961

[45] Date of Patent: Nov. 8, 1994

[54] FEEDING DEVICE OF A WIDE SEWING MATERIAL

[75] Inventors: Hideyuki Kobayashi; Masayuki Nozawa, both of Utsunomiya; Yashuhiro Nagayama, Tochigi, all of Japan

[73] Assignee: The Singer Company N.V., Caracao, Netherlands Antilles

[21] Appl. No.: 24,039

[22] Filed: Mar. 1, 1993

[30] Foreign Application Priority Data

May 19, 1992 [JP] Japan ..... 4-039544[U]

[51] Int. Cl.[5] ..... B65H 20/00; D05B 35/02

[52] U.S. Cl. ..... 226/171; 112/141; 112/304

[58] Field of Search ..... 226/171, 170, 179, 174, 226/108, 172; 112/141, 147, 304

[56] References Cited

U.S. PATENT DOCUMENTS

| | | | |
|---|---|---|---|
| 3,010,565 | 11/1961 | Palinski | 226/171 X |
| 3,112,054 | 11/1963 | Fleissner | 226/170 X |
| 4,068,603 | 1/1978 | Arbter | 112/304 X |
| 4,464,160 | 8/1984 | Joyce | 112/141 X |
| 4,957,052 | 9/1990 | Sotome et al. | 112/147 |
| 5,299,515 | 4/1994 | Baba et al. | 112/141 |

FOREIGN PATENT DOCUMENTS

| | | | |
|---|---|---|---|
| 3315663 | 12/1988 | Japan | 226/174 |

*Primary Examiner*—Daniel P. Stodola
*Assistant Examiner*—Michael R. Mansen

[57] ABSTRACT

A feeding device of a wide sewing material comprises a first belt conveyer unit provided on a supporting member vertically driven by a first elevating unit, a first base plate vertically driven by a second elevating unit provided on the supporting member, a horizontally driving unit for horizontally driving a second base plate and a second belt conveyer unit which is supported by the second base plate and is arranged on the side of the edge portion to be sewn of the wide sewing material in parallel therewith and which is driven to rotate by a rotary device. Since the feeding device can secure a large space from the edge portion by retracting the second belt conveyer units, next operation can be performed with ease. As a result, it is possible to perform the feeding and sewing of a wide sewing material, which is difficult to work at the edge portion thereof automatically, with accuracy and efficiency.

1 Claim, 8 Drawing Sheets

FEEDING DEVICE OF A WIDE SEWING MATERIAL

BACKGROUND OF THE INVENTION

1. Field of the Invention

The present invention relates to a feeding device of a wide sewing material for an automatic sewing device.

2. Description of the Related Art

As a conventional wide sewing material, for example, a towel sheet is known. In manufacturing the towel sheet, a towel sheet material is cut off sheet by sheet from a master roll and the cut towel sheet material is manually folded in three at the edge portion thereof and is sewn in the threefold hemming portion thereof to finish a towel sheet. However, performing the sewing operation while manually folding in three the edge portion of the wide towel sheet material which is soft and lacks firmness requires a skilled work, and moreover takes much labor and time, so that it is not suitable for mass production and costs high.

As to the automatic sewing of the threefold hemming portion of a towel cloth having a usual width, the applicant of the present invention proposed an automatic threefold folding device of the edge portion of a towel cloth as shown in U.S. Pat. No. 4,957,052. Although it is possible to fold the edge portion of the towel sheet material in three by feeding the edge portion thereof to a threefold folding device having a similar structure as the aforementioned invention, the towel sheet material is too wide to be within reach of an operator's hands so that it is difficult to put the towel sheet material in order on a work table at a predetermined position so as to feed the same to the threefold folding device. As a result, the threefold hemming portion cannot have a correct shape.

Moreover, since the size of the threefold portion is larger than that of a towel having a usual width, the presser for feeding the edge portion of the towel sheet material to the threefold hemming portion has to be displaced further than that of the conventional threefold folding device set forth above. As described above, since the towel sheet material has a large edge portion to be folded, it is impossible to be fed to the threefold folding device with the tip end of the edge portion thereof arranged linearly, so that the threefold hemming portion cannot have a proper shape.

SUMMARY OF THE INVENTION

The present invention has been made in view of such a conventional technical problem to provide a feeding device of a wide sewing material put on a work table projecting from a frame to next process, the feeding device being arranged in the sewing material putting area of an automatic sewing device, characterized in that the feeding device further comprises:

a first elevating unit provided on the france above the work table;

a first belt conveyer unit which is provided on a supporting member vertically moved by the first elevating unit and which is driven to turn by a rotary device;

a second elevating unit provided on the supporting member;

a first base plate vertically moved by the second elevating unit;

a horizontally driving unit provided on the first base plate for driving a second base plate slidably supported by the first base plate thereunder in the horizontal direction which intersects the extension of the first belt conveyer unit at right angles; and a second belt conveyer unit which is provided on the side of the edge portion to be sewn of the wide sewing material relative to the first belt conveyer unit in parallel therewith and is driven to rotate by the rotary device.

A second gear coaxially fixed to a second driving pulley of the second belt conveyer unit always engages a second pinion at an end portion of a pinion shaft rotatably supported by the second base plate and a first pinion at the other end portion of the pinion shaft engages a first gear coaxially fixed to a first driving pulley of the first belt conveyer unit, at the state that the second belt conveyer unit is horizontally driven by the horizontally driving unit so as to be separated from the first belt conveyer unit and the first base plate is lowered by the second elevating unit, the first and second belt conveyer units being able to be driven by a single rotary device.

As understood from the above description, one of the belt conveyer units of the feeding device of a wide sewing material such as a towel sheet is moved away to secure a large space after completion of feeding for next process such as threefold folding which is performed about the portion of the sewing material which has been pressed down by the belt conveyer unit, so that it is possible to perform the next process with accuracy and ease. As a result, the feeding and sewing of a wide sewing material which is difficult in automatic working at the edge portion thereof due to its softness and lack of stiffness can be performed efficiently, which attributes to the rationalization of a sewing work.

DESCRIPTION OF THE PREFERRED EMBODIMENT

An embodiment of the present invention will be described hereinafter.

Figure 4:
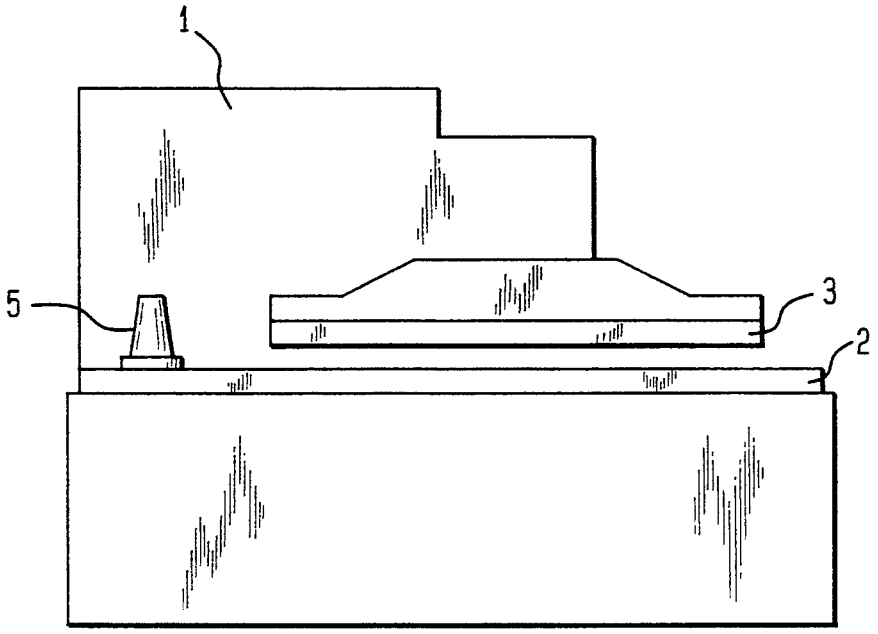
FIG. 4 is a front view showing the automatic sewing device in FIG. 1.
Figure 5:
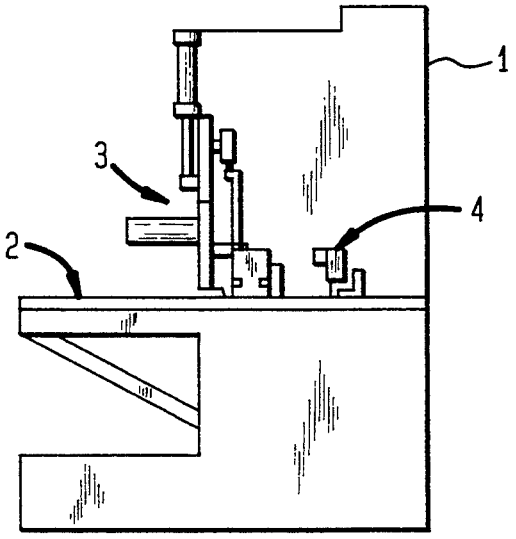
FIG. 5 is a side view showing the automatic sewing device in FIG. 1.

FIGS. 1 to 14 show the embodiment of the present invention applied to a threefold hemming automatic sewing device for a wide sewing material. The arrangement of units in such an automatic sewing device will be described hereinafter with reference to FIGS. 4 and 5. In the figures denoted at 1 is a frame, and on a work table 2 projecting from the frame 1, there are a feeding device 3 of a wide sewing material, a threefold folding device 4 provided in parallel therewith for folding in three the edge portion of the wide sewing material fed by the feeding device 3 and a sewing unit 5 for sewing the edge portion folded in three of the wide sewing material, which are arranged in order from the starting end side of the work table 2. The feeding device 3 of the wide sewing material is arranged in the area of the automatic sewing device in which the sewing material is put. The wide sewing materials will be represented by a towel sheet material A in the following description.

Figure 14:
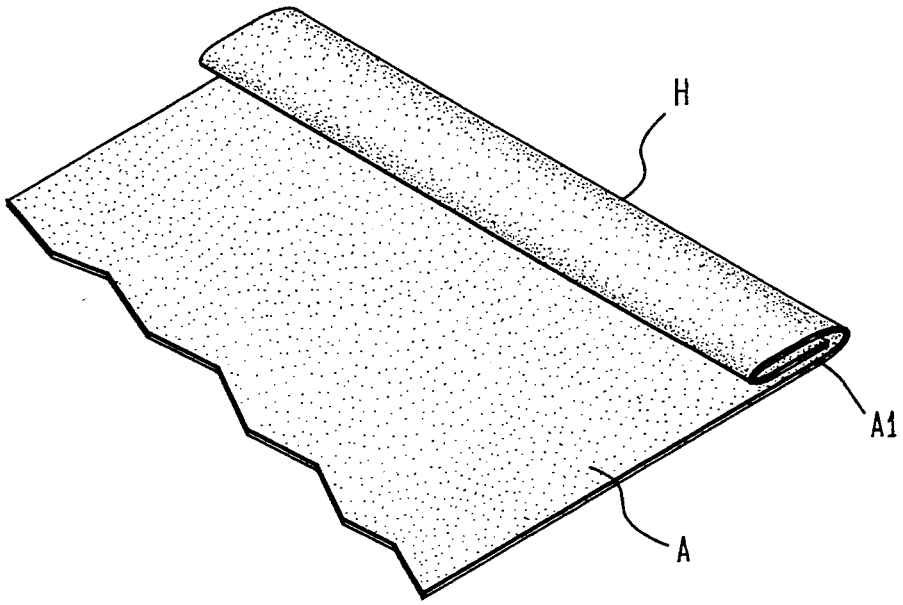
FIG. 14 is a perspective view showing a towel sheet material to be sewn by the automatic sewing device in FIG. 1.

The towel sheet material A which has been cut at a given length is put on the starting end portion (the fight end in FIG. 4) of a work table 2 with the edge portion A1 thereof on the side of the threefold folding device 4, is conveyed along the work table 2 toward a sewing unit 5 by the feeding device 3 of the wide sewing material, is fed to the threefold folding device 4 at the edge portion A1 thereof to form the threefold portion H as illustrated in FIG. 14 and thereafter is conveyed to the sewing unit 5 so as to be sewn in the threefold portion H thereof.

Figure 1:
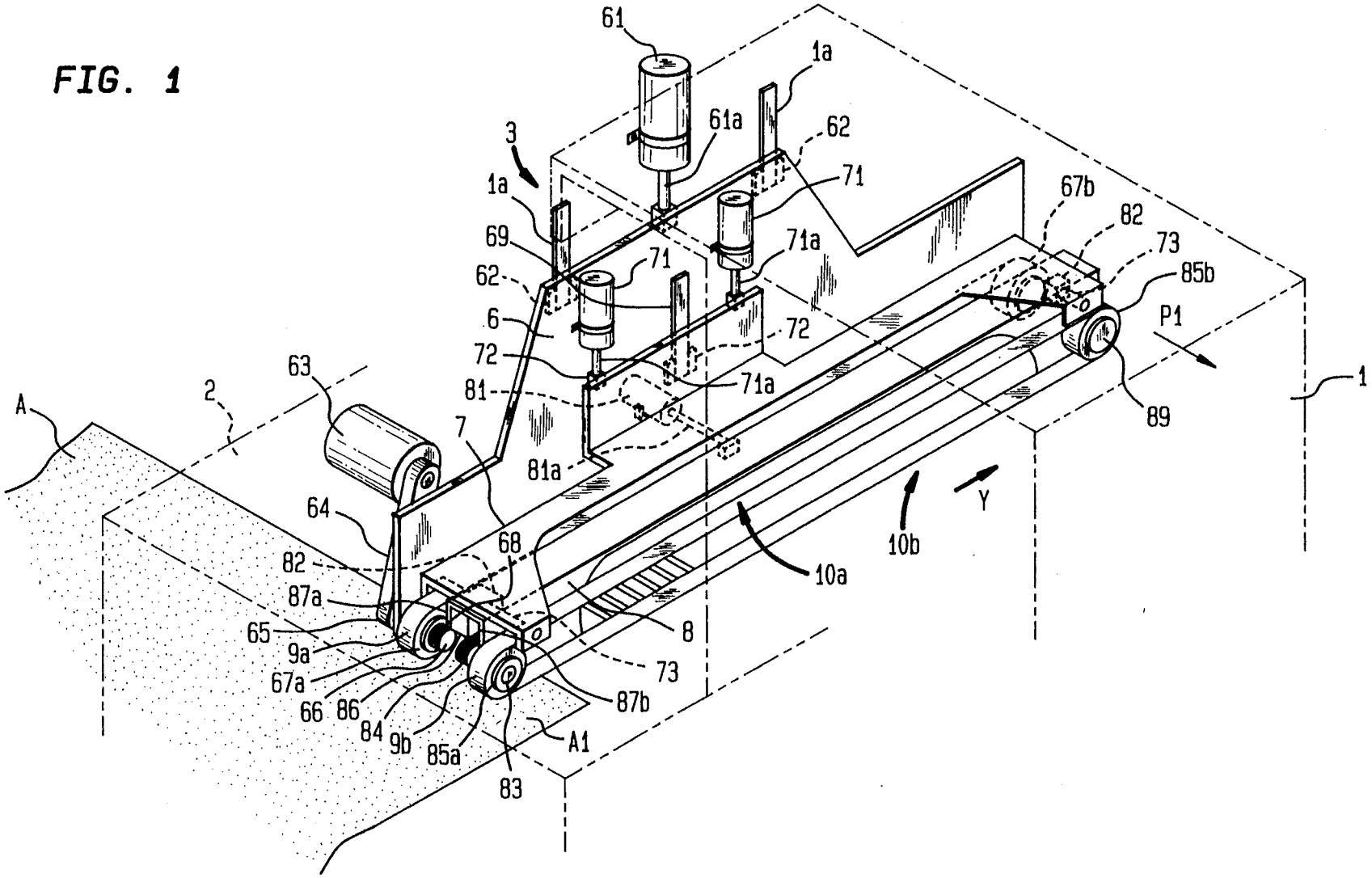
FIG. 1 is a perspective view showing a feeding device of a wide sewing material according to an embodiment of the present invention.

The feeding device 3 of the wide sewing material will be described with reference to FIGS. 1 to 3.

Denoted at 6 is a vertically extending supporting member which is is provided above the work table 2 and is movable vertically. The supporting member 6 is fixed to the tip end portion of the piston rod 61*a* of a first pneumatic actuator 61 which is a first elevating unit fixedly mounted on the frame 1. The supporting member 6 lowers when the piston rod 61*a* is operated forward, and rises when it is operated backward. The supporting member 6 moves vertically as a first linear guide 62 fixedly mounted thereon is guided by a pair of guide rails 1*a* provided on the side of the frame 1.

A first belt conveyer unit 10*a* is arranged on one side of the supporting member 6. The first belt conveyer unit 10*a* is composed of a first driving pulley 67*a* fixed to one end portion of a belt pulley driving shaft 66 piercing one end portion (the left end portion in FIG. 1) of the supporting member 6 and rotatably supported thereby, a first driven pulley 67*b* rotatably supported by the other end portion of the supporting member 6 and a first conveyer belt 9*a* wound around the first driving pulley 67*a* and the first driven pulley 67*b*. The first driving pulley 67*a* is driven to rotate by a driving motor 63 which is a rotary device fixed to one end portion of the supporting men, bet 6 by way of a bracket, not shown. That is, the motor-driven pulley 65 fixed to the other end portion of the belt pulley driving shaft 66 is driven to rotate by way of a driving belt 64 wound around the shaft of the driving motor 63 and the motor-driven pulley 65. With this arrangement, a towel sheet material A put on the upper surface of the work table 2 can be conveyed in the direction of the arrow Y by the first conveyer belt 9*a*.

Denoted at 7 is a first base plate. The first base plate 7 is fixed to the tip end portions of the piston rods 71*a* of a pair of second pneumatic actuators 71 which are the second elevating units fixed to the supporting member 6 and are vertically movable as a second linear guide 72 is guided by a guide rail 69 fixed in front of the supporting member 6. The first base plate 7 is bent downward at the both sides of the both end portions thereof so as to form two pairs of brackets confronting each other, and each guide rail 73 is fixed to each pair of the brackets so as to horizontally extend therebetween.

A second base plate 8 is slidably supported under the first base plate 7 by a pair of the guide rails 73 by way of guides 82 composed of bush member engaging the guide rails 73 respectively. A piston rod 81*a* of a third pneumatic actuator 81 which is a horizontally driving unit horizontally mounted on the back surface of the first base plate 7 is fixed to the second base plate 8 at the tip end portion thereof. The second base plate 8 moves in the horizontal direction intersecting the extension of the first conveyer belt 9*a* at right angles as each guide 82 is guided by the corresponding guide rail 73 so as to be extended from or contracted into the first base plate 7.

Figure 2:
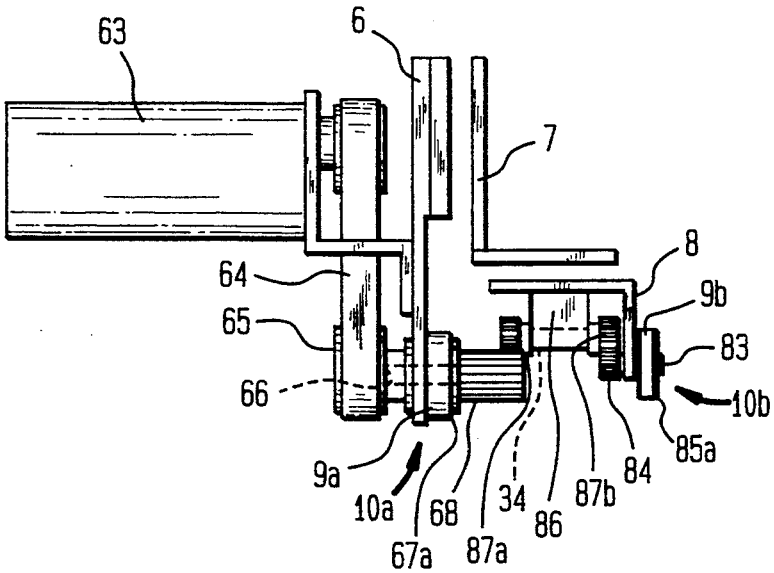
FIG. 2 is a view showing an end portion of a second base plate in FIG. 1.

One end portion (the left end portion in FIG. 1) of the second base plate 8 is bent downward at the outer side thereof as illustrated in detail in FIG. 2 so as to rotatably support the belt pulley driving shaft 83, to the inner end portion of which is fixed a second gear 84, and to the outer end portion of which is fixed a second driving pulley 85*a* coaxially with the second gear 84. At the central portion of one end portion of the second base plate 8 is fixed a gear bracket 86 extending downward, by which a pinion shaft 34 is rotatably supported as illustrated in FIG. 2. The pinion shaft 34 extends in the same direction as that of the piston rod 81*a* of a third pneumatic actuator 81, and a second pinion 87*b* always engaging the second gear 84 is fixed to one end portion of the pinion shaft 34 and a first pinion 87*a* capable of engaging the first gear 68 coaxially fixed to the first driving pulley 67*a* is fixed to the other end thereof. The gear ratio of the both pinions 87*a* and 87*b* and that of the both gears 68 and 84 are set to be the same so that the both pulleys 67*a* and 85*a* may rotate at a same circumferential speed.

Figure 3:
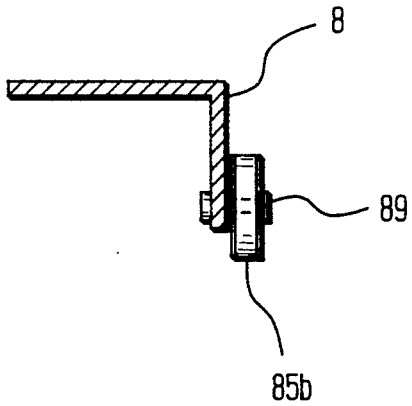
FIG. 3 is a view showing the part of the other end portion of the second base plate in FIG. 1.

On the other hand, a supporting shaft 89 is fixed to a bracket formed by bending downward the outer side of the other end portion (the right end portion in FIG. 1) of the second base plate 8 as illustrated in detail in FIG. 3, and a second driven pulley 85*b* is rotatably supported by the supporting shaft 89. A second conveyer belt 9*b* is wound around the both pulleys 85*a* and 85*b*, forming a second belt conveyer unit 10*b*. The second belt conveyer unit 10*b* is arranged on the side of the edge portion A1 to be sewn of the towel sheet material A relative to the first conveyer belt unit 10*a* in parallel therewith. The threefold folding device 4 is arranged on the opposite side of the first belt conveyer unit 10*a* adjacent to the central portion of the second belt conveyer unit 10*b* so as to face the same.

When the driving motor 63 is driven, the motor-driven pulley 65 is driven by way of the driving belt 64 so as to drive the first driving pulley 67*a* when the first gear 68 engages the first pinion 87*a*, the first gear 68, the first pinion 87*a*, the pinion shaft 34, the second pinion 87*b*, the second gear 84, the belt pulley driving shaft 83 and the second driving pulley 85*a* which rotate together with the first driving pulley 67*a* are driven to rotate.

Whereby the first conveyer belt 9a and the second conveyer belt 9b are driven to rotate, so that it is possible to convey the towel sheet material A clamped between the both conveyer belts 9a and 9b and the work table 2 in the direction of the arrow Y.

The operation of the aforementioned embodiment will be described hereinafter.

The automatic sewing device including the feeding device 3 of a wide sewing material begins its operation at the state that the operator puts the end edge portion of the towel sheet material A cut off at a given length from a master roll on the work table 2.

Figure 6:
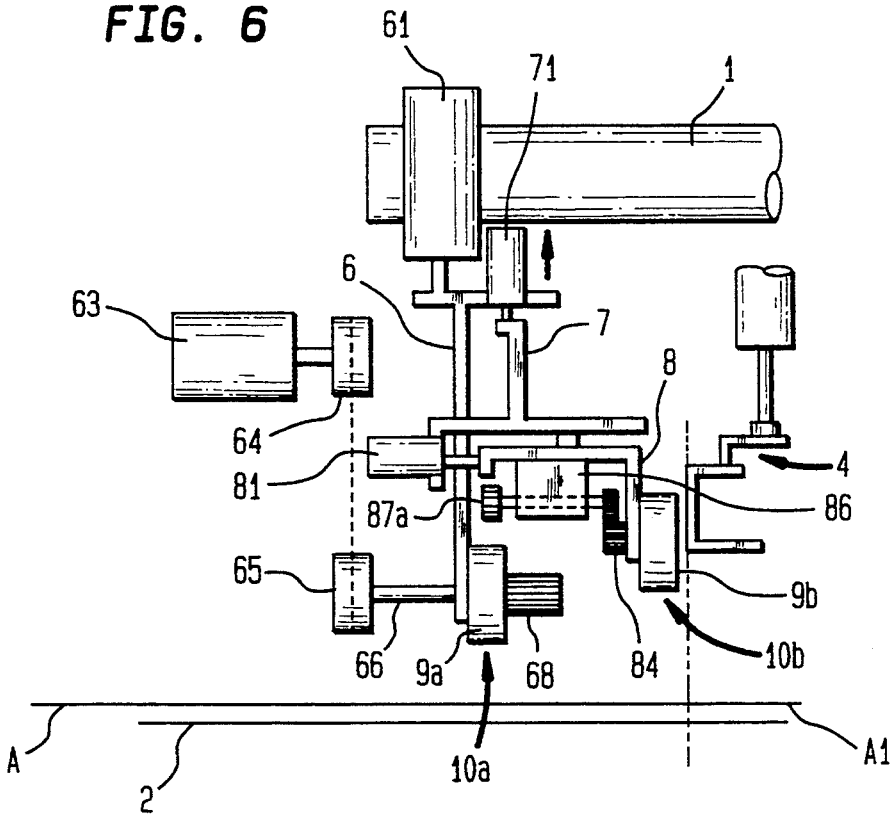
FIG. 6 is a view for explaining the operation of the automatic sewing device in FIG. 1.

Referring to FIG. 6, the first and second belt conveyer units 10a and 10b are both returned to the upper home positions thereof by the backward operation of the first pneumatic actuator 61. At this state, the driving motor 63 is stopped and the first base plate 7 is raised together with the second base plate 8 by the backward operation of the second pneumatic actuator 71 so that the first pinion 87a supported by the gear bracket 86 comes off the first gear 68 fixed to the belt pulley driving shaft 66. Accordingly, the second conveyer belt unit 10b is positioned upper relative to the first conveyer belt unit 10a.

The towel sheet material A is inserted deeply between the first and second belt conveyer units 10a and 10b which has been returned to their home positions and the work table 2 so as to be located at a given position. That is, the edge portion A1 to be sewn of the towel sheet material A is positioned under the second belt conveyer unit 10b adjacent to the threefold folding device 4 on the extension thereof taking into consideration the width to form the threefold portion H.

Figure 7:
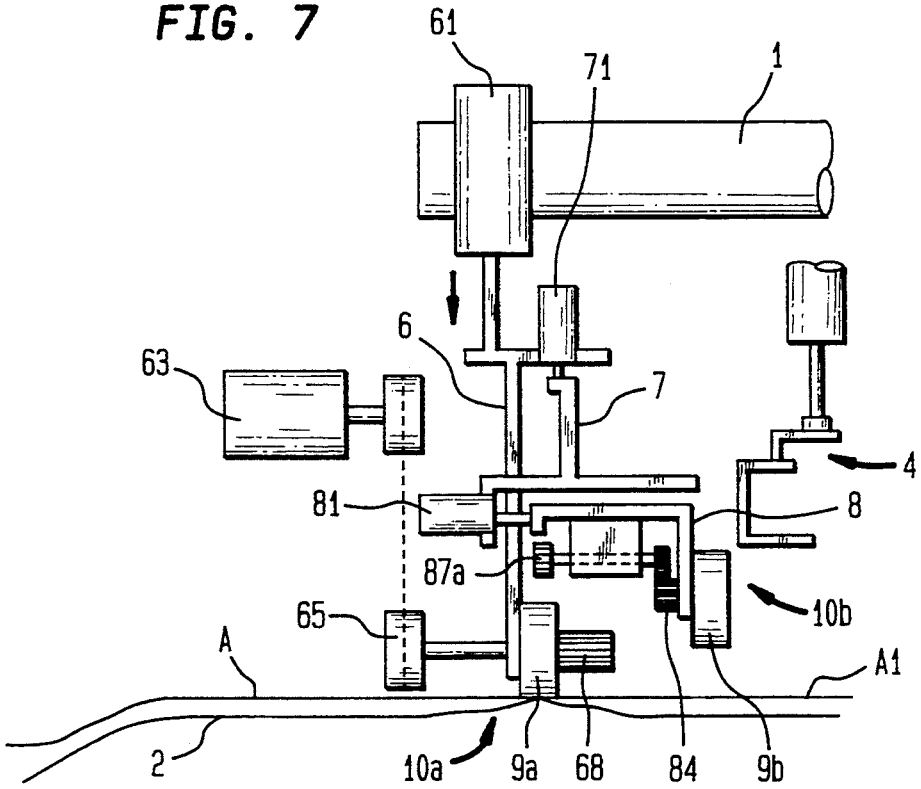
FIG. 7 is a view for explaining the operation of the automatic sewing device in FIG. 1.

Referring to FIG. 7, the supporting member 6 is lowered by the forward operation of the first pneumatic actuator 61 so as to lower the first and second belt conveyer units 10a and 10b. Since the second belt conveyer unit 10b is positioned upper relative to the first belt conveyer unit 10a by the backward operation of the second pneumatic actuator 71, the first conveyer belt 9a of the first belt conveyer unit 10a is pressed on the upper surface of the towel sheet material A.

Figure 8:
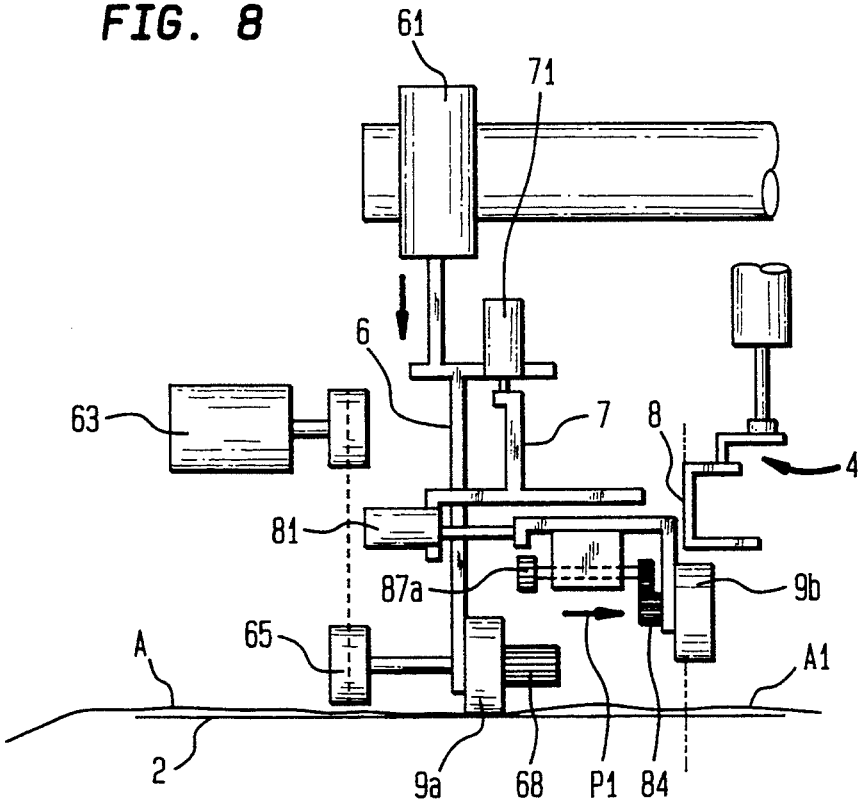
FIG. 8 is a view for explaining the operation of the automatic sewing device in FIG. 1.

Referring to FIG. 8, the second base plate 8 is projected horizontally (in the direction of the arrow P1), the first pinion 87a is positioned above the first gear 68 and the second conveyer belt 9b of the second belt conveyer unit 10b is positioned approximately above the edge portion A1 of the towel sheet material A by the forward operation of the second pneumatic actuator 71.

Figure 9:
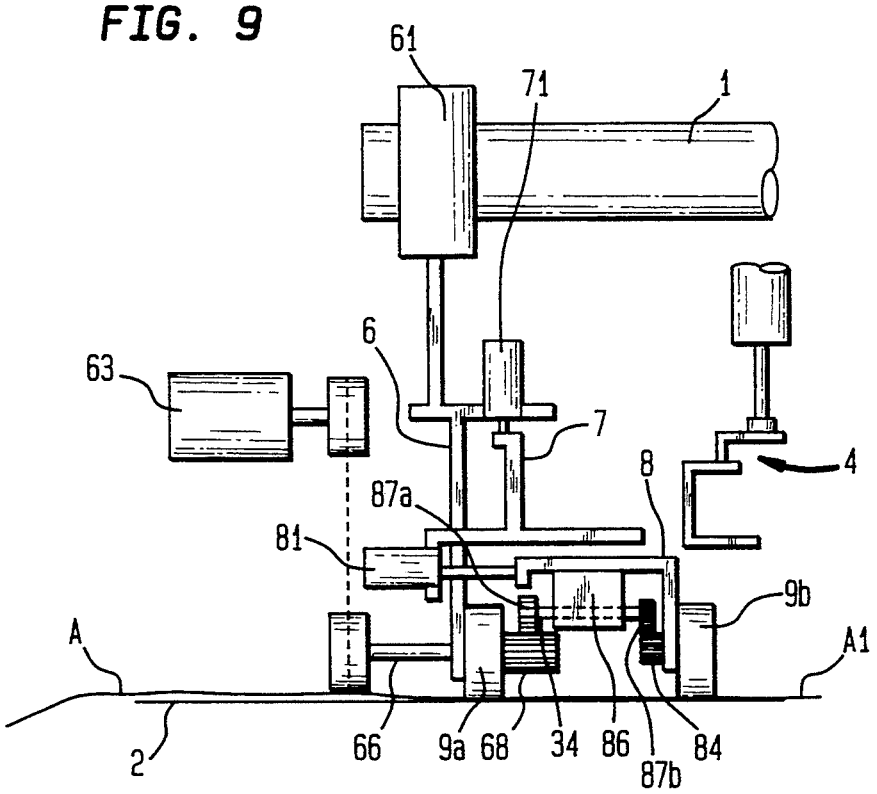
FIG. 9 is a view for explaining the operation of the automatic sewing device in FIG. 1.

Referring to FIG. 9, the first base plate 7 is lowered together with the second base plate 8 by the forward operation of the second pneumatic actuator 71 so as to lower the second belt conveyer unit 10b onto the work table 2. Whereby the second conveyer belt 9b presses the upper surface of the towel sheet material A at the position adjacent to the edge portion A1 thereof. At the same time, the first pinion 87a supported by the gear bracket 86 engages the first gear 68 fixed to the belt pulley driving shaft 66.

Thereafter, when the driving motor 63 is driven, the both belt pulley driving shafts 66 and 83 rotate to start driving the first conveyer belt 9a and the second conveyer belt 9b so as to convey the towel sheet material A on the work table 2 positioned at an end portion thereof in the direction of the arrow Y and feed the same to the area of the threefold folding device 4 facing the approximately central portion of the second conveyer belt 9b. Since the both pulleys 67a and 85a are constructed so as to rotate at a same circumferential speed and the towel sheet material A is conveyed by the first conveyer belt 9a and the second conveyer belt 9b which are separated from each other at a given distance, the towel sheet material A is well prevented from being distorted.

Figure 10:
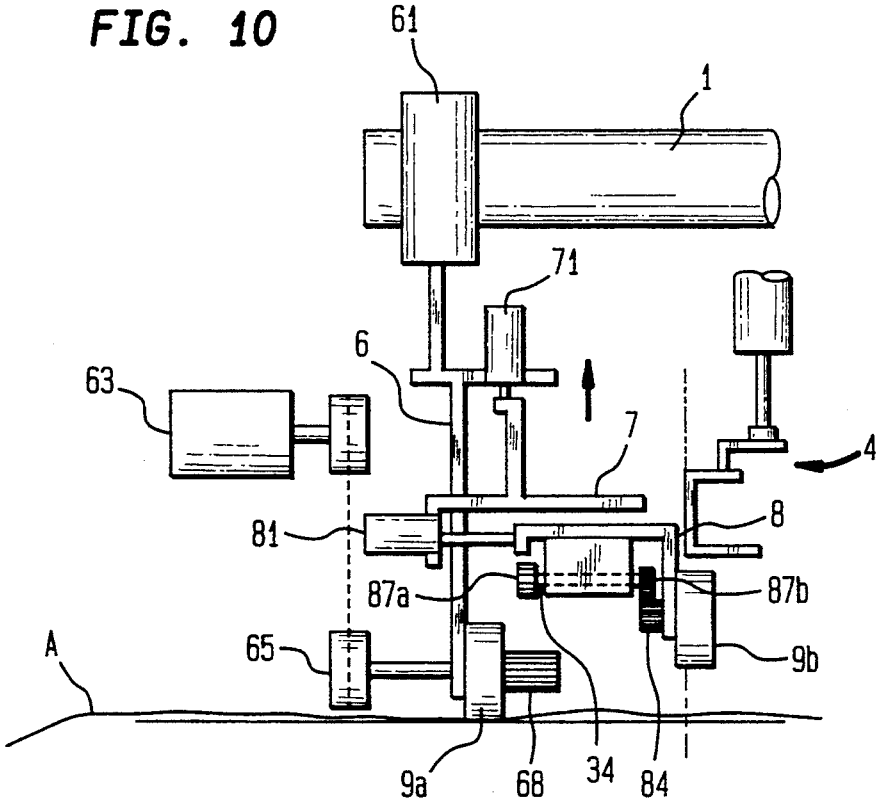
FIG. 10 is a view for explaining the operation of the automatic sewing device in FIG. 1.

Referring to FIG. 10, when the towel sheet material A is conveyed to a given position under the threefold folding device 4, the driving motor 63 is stopped and the second pneumatic actuator 71 is operated backward to raise the second belt conveyer unit 10b to its home position. Whereby the first pinion 87a of the second base plate 8 comes off the first gear 68 on the belt pulley driving shaft 66 and the second conveyer belt 9b is separated from the upper surface of the towel sheet material A.

Figure 11:
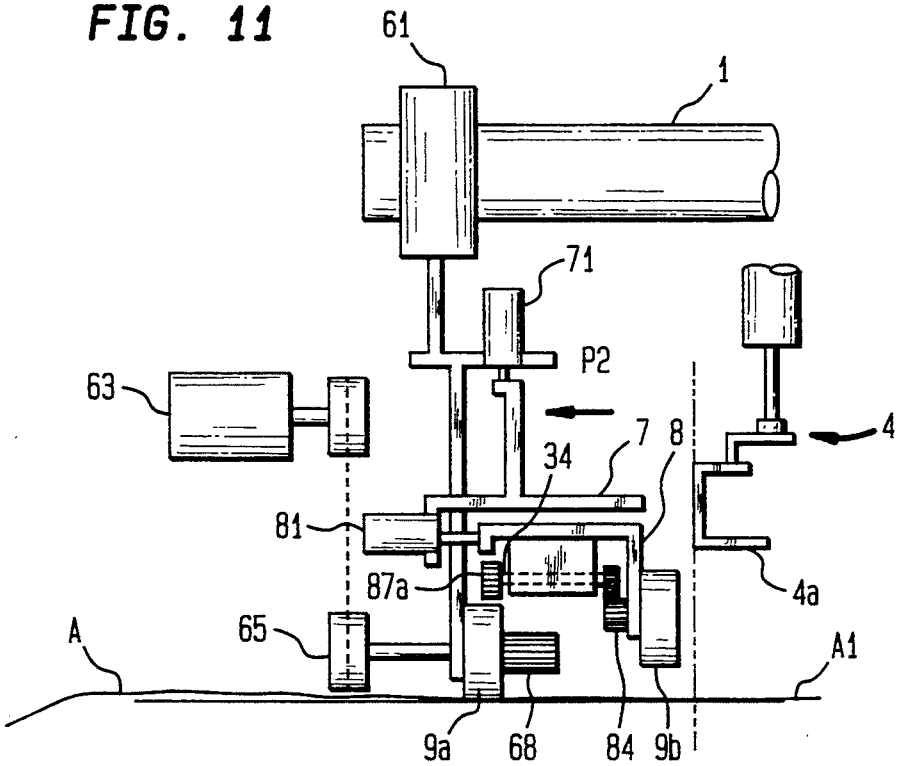
FIG. 11 is a view for explaining the operation of the automatic sewing device in FIG. 1.

Referring to FIG. 11, the second base plate 8 is horizontally displaced in the direction of the arrow P2 by the backward operation of the third pneumatic actuator 81 so as to secure an enough space adjacent to the edge portion A1 of the towel sheet material A. That is, the second conveyer belt 9b is retracted to the position where it does not obstruct the operation of the threefold folding ruler 4a of the threefold folding device 4.

At this state, the threefold folding device 4 starts its operation and it approaches the edge portion A1 of the towel sheet material A.

Figure 12:
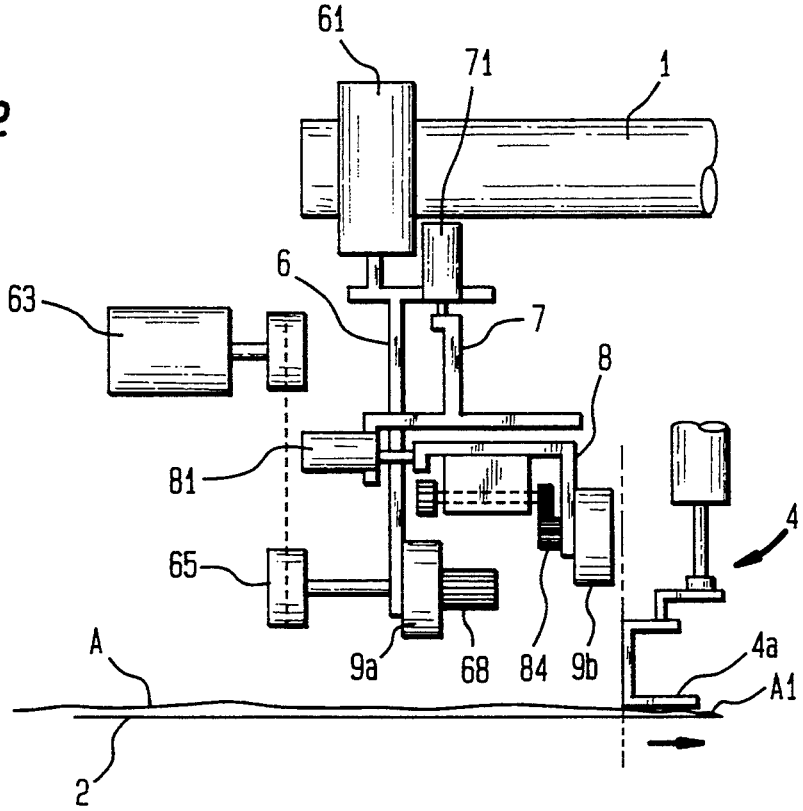
FIG. 12 is a view for explaining the operation of the automatic sewing device in FIG. 1.

Referring to FIG. 12, when the threefold folding ruler 4a of the threefold folding device 4 lowers to regulate the edge portion A1 of the towel sheet material A, the first pneumatic actuator 61 is operated backward so as to separate also the first belt conveyer unit 10a from the towel sheet material A and start the threefold folding operation. Since the towel sheet material A is pressed by the threefold folding ruler 4a while the first belt conveyer unit 10a presses the same, the towel sheet material A is pressed by the threefold folding ruler 4a at a given position thereof without being displaced from the predetermined position. Moreover, since the threefold folding ruler 4a presses the towel sheet material A at the position adjacent to that where the second conveyer belt 9b has pressed the towel sheet material A, the towel sheet material A can be folded in three at the nondistorted portion thereof in the following process.

As to the threefold folding process of the edge portion A1 of the towel sheet material A, it may be the same as the conventional well-known process such as that described in detail by the applicant of the present invention in U.S. Pat. No. 4,957,052, (threefold folding device for towel hemming), so that the description thereof is omitted.

Figure 13:
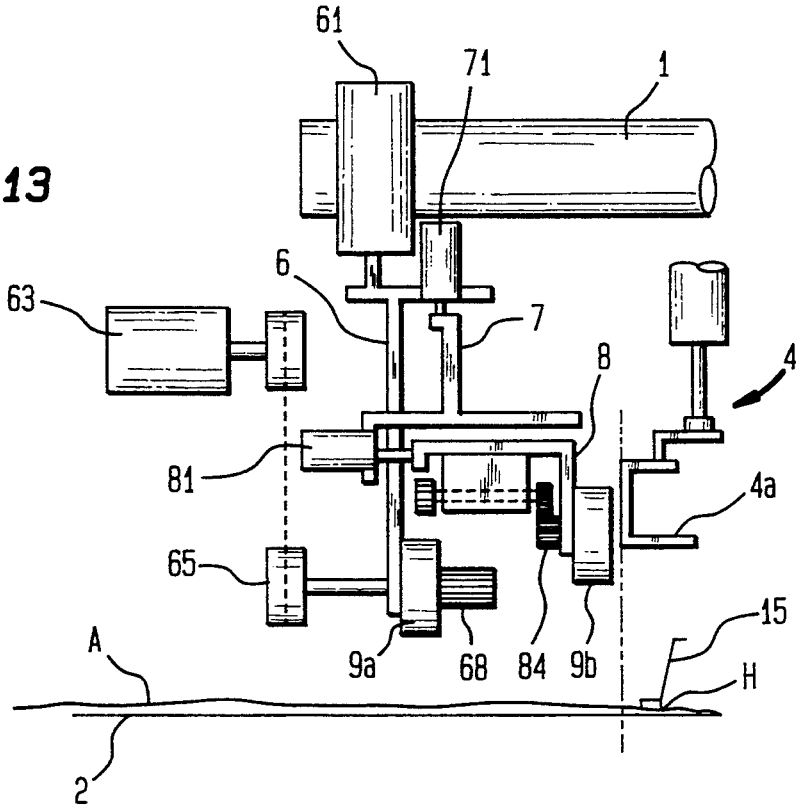
FIG. 13 is a view for explaining the operation of the automatic sewing device in FIG. 1.

Referring to FIG. 13, a well-known conveying presser 15 is displaced to press the towel sheet material A at the threefold portion H for conveying the same to the sewing unit 5 after completion of threefold folding operation of the edge portion A1 of the towel sheet material A by the threefold folding device 4. Thereafter the towel sheet material A is sewn in the threefold portion H by the sewing unit 5.

By repeating these processes, the edge portion A1 of the towel sheet material A which has been manually fed is automatically folded in three and sewn therein to form a towel sheet.

Although a single driving motor 63 drives the first driving pulley 67a and the first gear 68 to rotate the same according to the embodiment set forth above, it is possible that a single driving motor mounted on the second base plate 8 drives the first pinion 87a and the second pinion 87*b* to rotate the same too. Furthermore, it is also possible to rotate the first driving pulley 67*a* and the second driving pulley 85*a* individually and in synchronism with each other by two driving motors.

In such a feeding device of a wide sewing material as set forth above, the automatic sewing device including the feeding device of a wide sewing material starts operation at the state that the operator put the wide sewing material such as a towel sheet material which has been cut off at a given length from a master roll on the work table. At that time the first and second belt conveyer units have been returned to their home position by the first elevating unit. The rotary device is stopped and the first base plate has been raised by the second elevating unit, so that the second belt conveyer unit is positioned upper relative to the first belt conveyer unit. The wide sewing material is deeply inserted between the first and second belt conveyer units which have been raised to their home positions and the working table so as to be at a given position.

The supporting member is lowered by the operation of the first elevating unit so as to lower the first and second belt conveyer units. Since the second belt conveyer-unit is positioned upper relative to the first belt conveyer unit, the first belt conveyer unit presses the upper surface of the wide sewing material. Then the horizontally driving unit is operated to project the second base plate horizontally so as to place the second belt conveyer unit approximately above the edge portion of the wide sewing material.

The first base plate is driven together with the second base plate to lower so as to lower the second belt conveying unit onto the working table by the operation of the second elevating unit thereby to press the upper surface of the wide sewing material at the position adjacent to the edge portion thereof by the second belt conveyer unit. Then the first and second belt conveyer units are driven by the rotary device to convey the wide sewing material on the work table so that it is possible to feed the wide sewing material to next process, for example, the area of threefold folding device.

Upon completion of feeding and conveying the wide sewing material, the rotary device is stopped and the second elevating unit is operated to raise the second belt conveyer unit to its home position. Furthermore, the horizontally driving unit is operated to return the second base plate to its home position so as to secure an enough space adjacent to the edge portion of the wide sewing material. As a result, the second belt conveyer unit can be retracted to the position where it does not obstruct the operation of a device of next process, e.g., the threefold folding device. At this state, next process starts its operation.

After repeating such processes, the edge portion of the wide sewing material fed manually is automatically subjected to working such as folding in three, sewing, etc.

According to claim 2, the first pinion comes off the first gear and the second belt conveyer unit is separated from the upper surface of the wide sewing material when the first base plate is raised by the second elevating unit. Furthermore, the first pinion at the other end portion of the pinion shaft engages the first gear fixed to the first driving pulley of the first belt conveyer unit when the second belt conveyer unit is horizontally driven by the horizontally driving unit to be separated from the first belt conveyer unit and the first base plate is lowered by the second elevating unit, so that both of the first and second belt conveyer units can be driven to rotate by a single rotary device. Accordingly, since the first and second belt conveyer units can be driven to rotate in accurate synchronism with each other with reduced number of rotary devices, the conveyed wide sewing material can be prevented from being distorted by a device of simple structure.

What is claimed is:

1. A feeding device for sewing material disposed on a work table projecting from a frame and comprising:

a first elevating unit provided on the frame above the work table;

vertical supporting member vertically driven by the first elevating unit;

a rotary device;

a first belt conveyer unit provided on said vertical/-supporting member and rotationally driven by the rotary device;

a second elevating unit provided on said vertical/supporting member;

a first base plate vertically moved by the second elevating unit;

a second base plate slidably supported by the first base plate;

a horizontally driving unit for horizontally driving the second base plate; and a second belt conveyer unit supported by the second base plate and arranged on a side of the sewing material relative to the first belt conveyer unit in parallel therewith, the second belt conveyer unit being rotationally driven by the rotary device.

* * * * *